US005105584A

United States Patent [19]

Gray

[11] Patent Number: 5,105,584

[45] Date of Patent: Apr. 21, 1992

[54] LENS CUTTING ASSEMBLY AND METHOD AND APPARATUS FOR EFFECTING RAPID REPLACEMENT OF LENS CUTTING TOOLS

[75] Inventor: Roy R. Gray, Muskogee, Okla.

[73] Assignee: Coburn Optical Industries, Inc., Tulsa, Okla.

[21] Appl. No.: 639,532

[22] Filed: Jan. 10, 1991

Related U.S. Application Data

[60] Division of Ser. No. 496,547, Mar. 8, 1990, Pat. No. 4,993,195, which is a division of Ser. No. 172,553, Mar. 24, 1988, Pat. No. 4,928,433, which is a continuation-in-part of Ser. No. 937,251, Dec. 3, 1986, abandoned.

[51] Int. Cl.[5] ..... B24B 49/00

[52] U.S. Cl. ..... 51/165.74; 51/165.87; 51/165.88

[58] Field of Search ..... 51/281 R, 165.87, 165.88, 51/5 D, 262 T, 165.74; 33/178 R, 504, 549

[56] References Cited

U.S. PATENT DOCUMENTS

| | | | |
|---|---|---|---|
| 1,047,511 | 12/1912 | Freeman | 51/165.74 |
| 2,493,332 | 1/1950 | Aubin | 51/165.74 |
| 4,269,000 | 5/1981 | Rutter | 51/165.74 |
| 4,837,983 | 6/1989 | Fuller, Jr. | 51/165.74 |

*Primary Examiner*—M. Rachuba

*Attorney, Agent, or Firm*—Burns, Doane, Swecker & Mathis

[57] ABSTRACT

Quick-change methods and apparatus enable the cutting tool of a lens cutting machine to be exchanged with minimal down time of the machine. A replacement cutting tool is gauged in an off-machine gauging mechanism while the machine is able to continue an on-going lens cutting operation. A stop surface of the replacement tool is adjusted in the gauging mechanism in order to reset the cutting edge, whereby subsequent insertion of the replacement tool in the machine assures that the cutting edge will be located in a predetermined reference plane of the machine.

3 Claims, 4 Drawing Sheets

Fig. 6
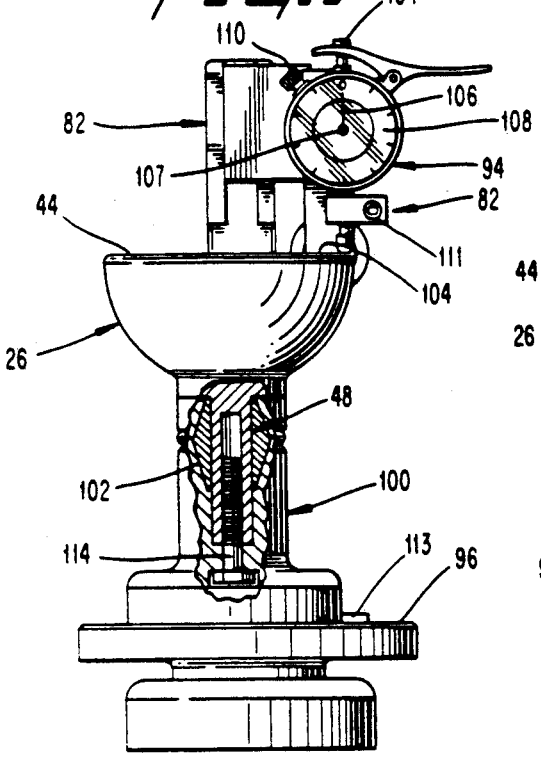
Fig. 7
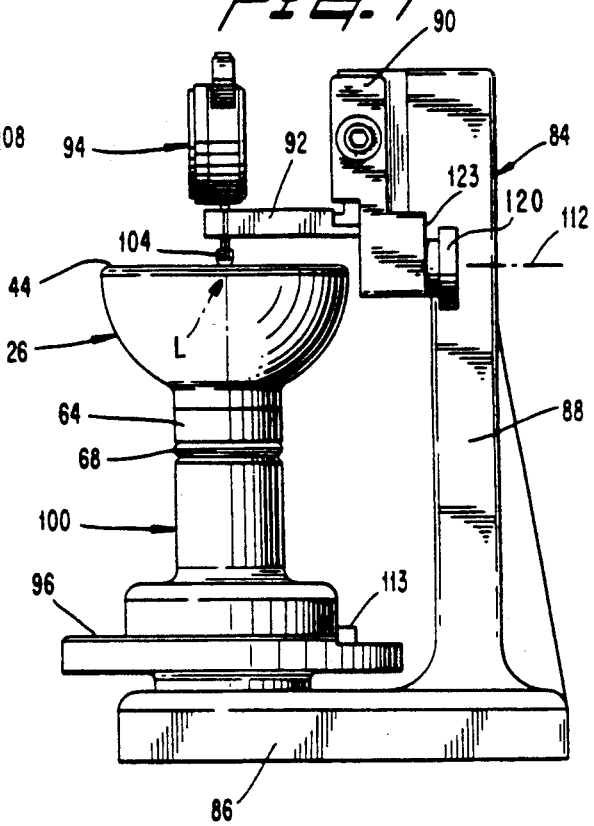
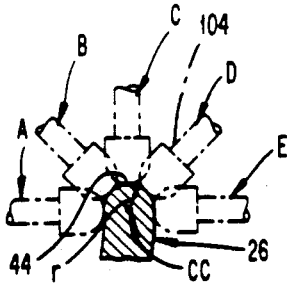
Fig. 9
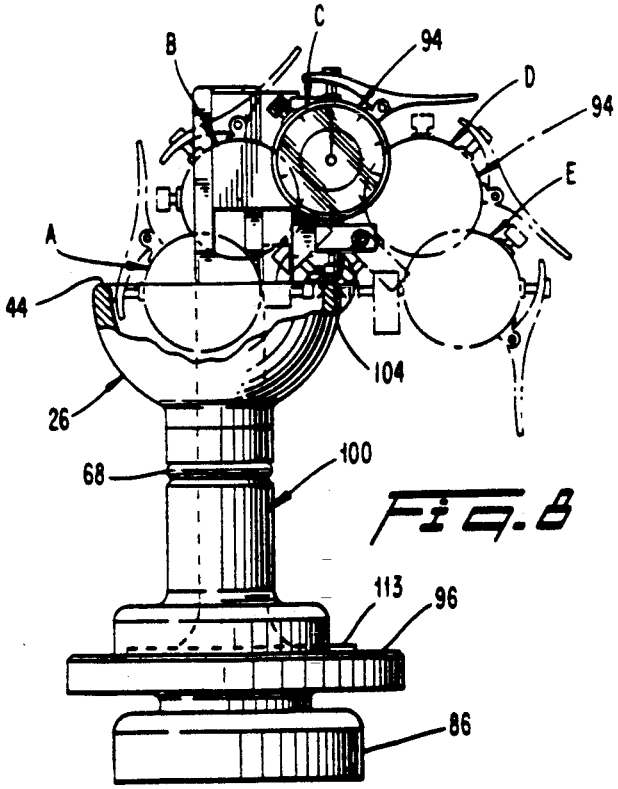
Fig. 8

Fig. 10
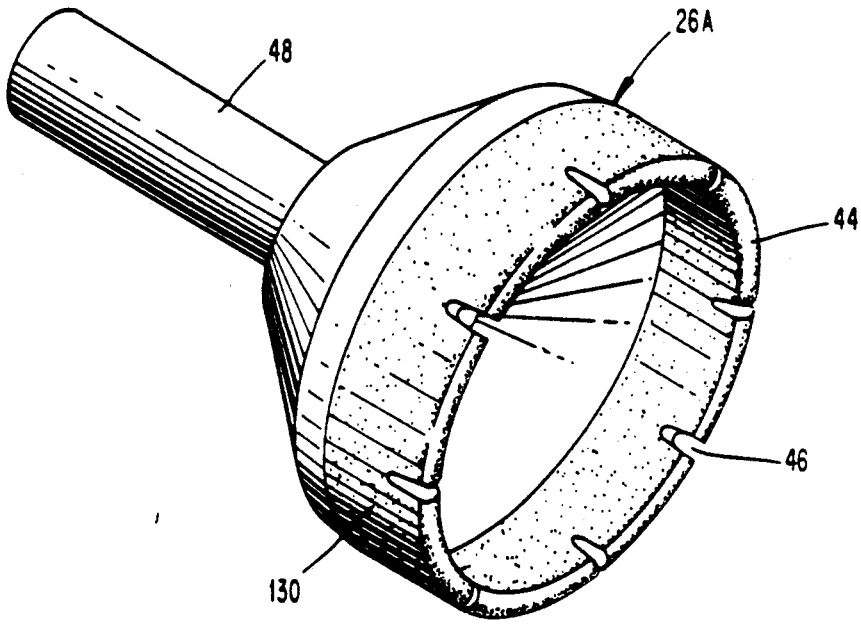
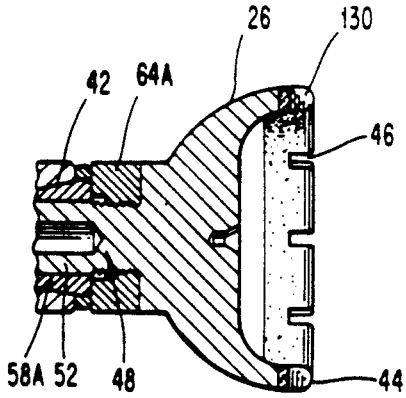
Fig. 12
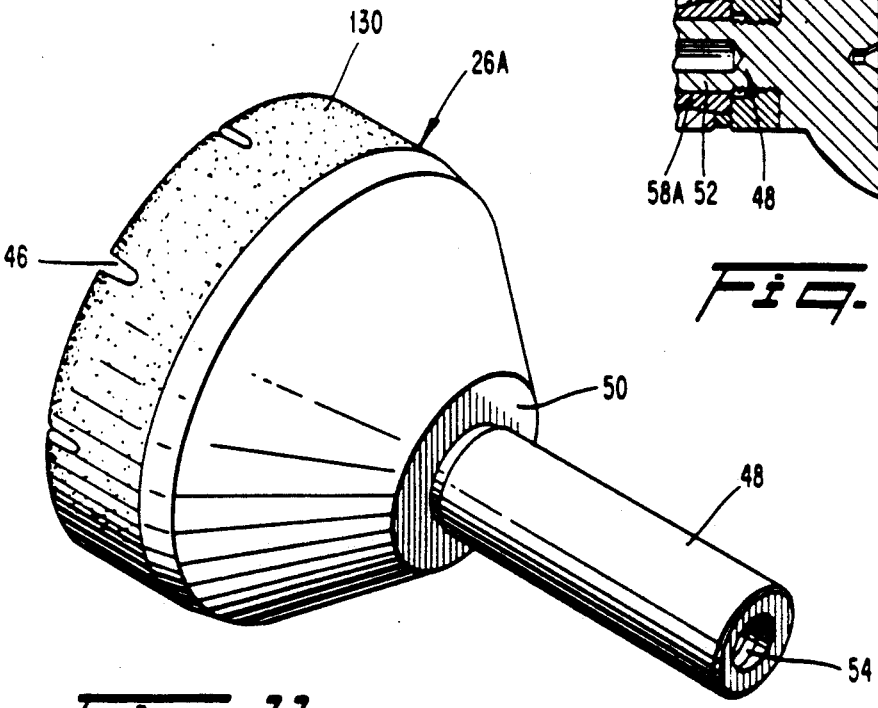
Fig. 11

LENS CUTTING ASSEMBLY AND METHOD AND APPARATUS FOR EFFECTING RAPID REPLACEMENT OF LENS CUTTING TOOLS

RELATED INVENTION

This application is a divisional of application Ser. No. 07/496,547, filed Mar. 8, 1990, now U.S. Pat. No. 4,993,195, which in turn is a division of application Ser. No. 07/172,553, filed Mar. 24, 1988, now U.S. Pat. No. 4,928,433 issued May 29, 1990, which is a continuation-in-part of application Ser. No. 06/937,251, filed Dec. 3, 1986, now abandoned, the disclosure of which is incorporated herein by reference in its entirety.

BACKGROUND OF THE INVENTION

The present invention relates generally to the generating of ophthalmic lenses from lens blanks made of polymeric material or of glass.

In a conventional lens generating technique, a lens blank is mounted in a holder, and a rapidly rotating lens grinding tool is applied to the surface of the lens blank in a precisely determined manner in order to generate a desired surface on the lens blank.

In conventional lens grinding machines, as disclosed for example in Coburn U.S. Pat. No. 2,806,327, the lens grinding tool comprises a metallic cup-shaped object whose front rim defines a cutting edge encrusted with hard abrasive material such as diamond grit, carbide, or the like. The cutting edge is not sharp, but rather is radiused about a center of curvature. The tool contains a hollow tapered shank extending from a rear side thereof. The tapered shank is received in a correspondingly tapered front socket of a rotary drive shaft. A bolt extends through the shaft and is threadedly received in a threaded hole in the tool shank for urging the tapered surfaces tightly together. The shaft is rotatably mounted in a spindle housing for rotation about a horizontal longitudinal axis and is driven by a motor operably connected to a rear end of the shaft.

During a cutting operation, pressurized fluid is directed toward the cutting edge for cooling and flushing purposes. The fluid is directed from a nozzle ring which surrounds the cutting edge. A splash hood encases the tool and lens to confine the water spray.

It will be appreciated that the generation of the desired surface on a lens blank involves extremely close tolerances and thus requires close control of the orientation of the grinding tool with respect to the lens blank. The machine is typically manually or automatically adjustable for moving the tool to specific orientations for generating a properly configured surface on the lens. In order to maintain the required close tolerances, it is necessary that the location of the tool cutting edge relative to a reference plane on the machine be established with certainty so that accurate adjustments can be made.

One conventional manner of precisely locating the cutting edge involves the use of a wheel set gauge 72 of the type depicted in FIG. 2 herein. That gauge 72 can be detachably mounted on the machine, e.g., mounted on a vertical pivot pin 73 defining an axis about which a toolcarrying portion of the machine is pivotable to effect one of the tool adjustments. The gauge includes a pin 74 which terminates at a fixed location, i.e., in a fixed vertical reference plane 70 relative to the pivot axis which is situated to assure that when the cutting edge 44 touches the pin, the afore-mentioned center of curvature CC of the cutting edge lies in a vertical plane P containing the pivot axis. That is, the planes P and 70 are spaced by a distance r equal to the radius of curvature of the cutting edge. Horizontal adjustment of the tool for bringing the cutting edge into engagement with the pin is achieved by longitudinally moving the spindle housing 22 in which the rotary shaft 24 is mounted. The spindle housing is mounted in a suitable machine clamp which can be loosened to accommodate such movement, whereupon the clamp is retightened.

On occasion, it is necessary to replace the cutting tool. Such tool exchanges are necessary, for example, when converting the machine to cut lenses of different material (e.g., when changing from glass lens cutting to plastic lens cutting), or when the lenses are to be cut to a different size, requiring a larger or smaller tool, or when the cutting edge becomes excessively worn. Regardless of the reason, it is necessary to check the location of the cutting edge relative to the pivot axis each time that a tool exchange is made, because of dimensional variances between the replacement tool and the tool being replaced. That is, unless the replacement tool is gauged, it cannot be assured that the replacement tool will be dimensioned such that its cutting edge will lie in the reference plane when the replacement tool is installed in the driven shaft.

The location of the cutting edge is checked by means of the wheel set gauge, an operation which has heretofore been a laborious and time-consuming operation, often requiring from one to two hours to accomplish. Such time and effort result from the need to remove the splash hood and water hoses leading to the water spray nozzle, as well as the need to attach the wheel set gauge to the machine and possibly scrape embedded glass dust from around the spindle housing to enable the latter to be adjusted. It will be appreciated that the machine is inoperable and unproductive during this entire procedure. For small facilities employing only a single machine, such down times are not infrequent and are highly costly in terms of lost production, as well as the need to employ a skilled technician to perform the aforedescribed tasks.

SUMMARY OF THE INVENTION

One aspect of the present invention relates to a lens cutting machine for generating a surface on a lens blank. The machine comprises a tool mounting assembly which is rotatable about an axis of rotation and includes a first stop surface. A tool includes a cutting edge for grinding a lens. The tool is removably mounted to the tool mounting assembly and carries a second stop surface engageable with the first stop surface to locate the tool relative to the machine. The second stop surface is longitudinally displaceable relative to the tool to locate the cutting edge at a predetermined position relative to the machine.

Preferably, the tool mounting assembly includes a first contact surface, and the tool carries a second contact surface extending substantially perpendicular to the axis and disposed opposite the first contact surface. One or more shims may be disposed between the first and second contact surfaces. A fastener releasably secures the tool to the tool mounting assembly such that the shim is compressed between the first and second contact surfaces to locate the cutting edge at a predetermined position relative to the tool mounting assembly.

Preferably, the tool mounting assembly includes a double tapered collet mounted on a shank portion of the tool, and a collar mounted on one of the tapers of the collet. The collar contains the first contact surface.

The present invention also relates to a method of replacing lens cutting tools in a lens cutting machine of the type which comprises a rotary driven shaft to which cutting tools are removably attachable in order to be driven about a longitudinal axis. The shaft includes a first stop surface engageable with a second stop surface carried by the tool for positioning the tool such that the cutting edge of the tool is aligned with a reference plane that is fixed relative to the machine. The shaft is adjustable to orient the cutting edge in a particular manner relative to a lens to be cut. The method comprises the step of gauging a longitudinal dimension defined by the replacement tool, with the latter disposed off-machine, while longitudinally displacing, as necessary, the second stop surface to thereby change the longitudinal dimension until the longitudinal dimension coincides with a predetermined dimension calibrated with respect to the stop surface and reference plane for positioning the cutting edge within the reference plane. Thereafter, the replacement cutting tool is attached to the shaft in place of a removed cutting tool.

The gauging step preferably comprises inserting the replacement tool in a gauging mechanism having a read-out which is precalibrated to zero-out when the predetermined dimension is obtained. Prior to being inserted in the engaging mechanism, the replacement tool is inserted into a holder which is configured identically to a tool-receiving end of the shaft.

Preferably, a collar is longitudinally movably mounted on a shank of the tool. Longitudinal movement of the collar produces longitudinal displacement of the second stop surface. Such movement can be effected by shims or by threadedly connecting the collar to the shank so that rotation of the collar produces longitudinal movement thereof.

The present invention also relates to a lens grinding tool which comprises an arcuate cutting edge disposed at a front end thereof. The cutting edge has abrasive grinding material thereon. The tool includes a shank extending from a rear end of the tool. The shank defines a planar surface extending substantially perpendicular to a longitudinal axis defined by the shank. The presence of the planar surface enables the cutting tool to receive an adjustment shim.

The present invention also relates to a gauging mechanism for gauging a longitudinal dimension defined by a lens grinding tool. The tool is of the type having an arcuate rim defining a cutting edge which is radiused about a center of curvature. The gauging mechanism comprises a stand defining a table, an arm disposed above the table, and a gauge mounted on the arm so as to be positioned over the table. The gauge includes a depending stem adapted to engage a cutting edge of a lens cutting tool seated on the table. An indicator is driven by the stem. The arm is rotatable about an axis extending substantially perpendicular to a projection of the stem so that the gauge is rotatable about the axis to enable the stem to engage the cutting edge at a plurality of locations around the curvature.

BRIEF DESCRIPTION OF THE DRAWINGS

The objects and advantages of the invention will become apparent from the following detailed description of a preferred embodiment thereof in connection with the accompanying drawings, in which like numerals designate like elements, and in which:

FIG. 6 is a front elevational view of the gauging mechanism, with a calibrating standard mounted thereon;

FIG. 7 is a side elevational view of the assembly depicted in FIG. 6;,

FIG. 8 is a view similar to FIG. 6 depicting the various positions in which a gauge may be disposed for measuring the cutting edge;

FIG. 9 is an enlargement of the cutting edge depicting the various positions in which the gauge may be disposed;

FIG. 10 is a front perspective view of a lens cutting tool according to the present invention;

FIG. 11 is a rear perspective view of the cutting tool depicted in FIG. 10; and FIG. 12 is a view similar to FIG. 4, depicting an alternative preferred embodiment of the invention.

DETAILED DESCRIPTION OF PREFERRED EMBODIMENTS OF THE INVENTION

Figure 1:
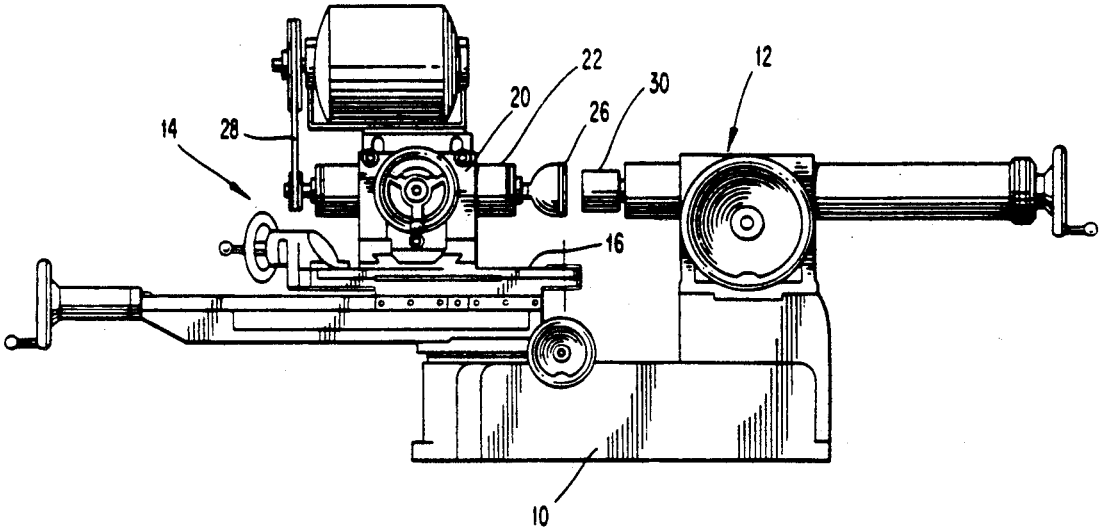
Fig. 1 (PRIOR ART)
FIG. 1 is a side elevational view of a conventional lens grinding machine in which the present invention may be incorporated.

Depicted in FIG. 1 is the basic structure of a lens generating machine. The machine comprises a base 10, a tail stock assembly 12, and a tool holding assembly 14, as described in Coburn U.S. Pat. No. 2,806,327. Such a machine is well-known, and thus a detailed description of the components thereof is not necessary herein. Basically, however, the tool holding assembly includes a base plate 16 which is pivotable about a pivot pin 18 (see FIG. 2) for pivotal movement in a horizontal plane. The base plate carries a bearing block 20 in which a quill or spindle housing 22 is mounted. As will be discussed hereinafter in greater detail, the spindle housing rotatably carries a shaft 24 in which a cutting tool 26 is mounted. A rear end of the shaft is driven in any suitable manner, such as by a motor-driven belt 28, although other drive mechanisms will become apparent to those skilled in the art. Various adjustments are provided on the machine for repositioning the tool to make specific cuts in a lens 30 mounted in the tail stock assembly 12.

Figure 3:
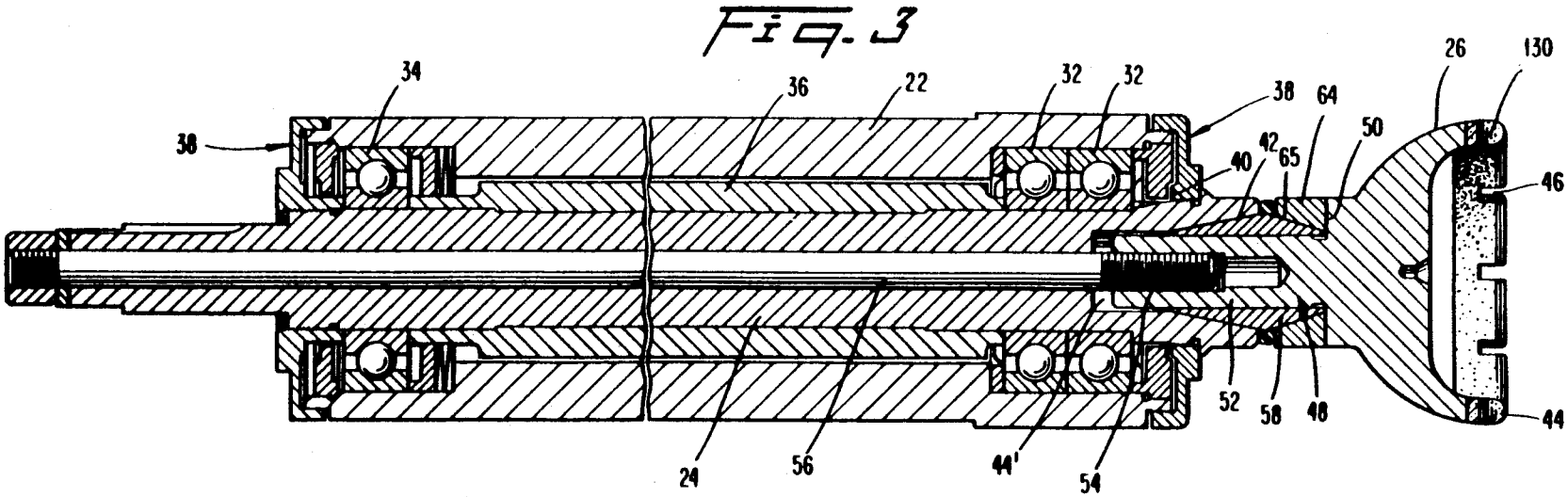
FIG. 3 is a longitudinal sectional view taken through a spindle housing of the machine in which the cutting tool is mounted.
Figure 5:
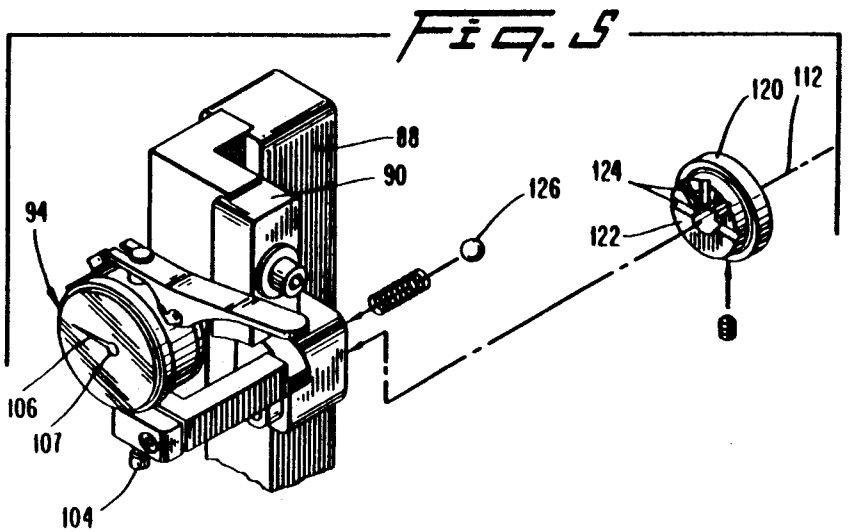
FIG. 5 is an exploded perspective view of a gauging mechanism according to the present invention.

As depicted in FIG. 3, the spindle housing comprises a hollow body in which are disposed front and rear ball bearing assemblies 32, 34. A spacer tube 36 extends between the front and rear bearing assemblies. The shaft 24 extends completely through the spindle housing and is rotatably carried by the bearing assemblies 32, 34 for rotation about a horizontal longitudinal axis. A rear end of the shaft projects beyond a rear end of the spindle housing for attachment to the motor-driven belt 28.

Adjacent a front end thereof, the shaft includes a radial shoulder 40 which abuts against the forwardmost bearing assembly 32. End caps 38 provided with suitable bushings seal the ends of the spindle bearing. The front end of the shaft terminates in a forwardly opened tapered socket 42. A cylindrical recess 44' extends rearwardly from a rear end of the tapered socket 42.

The lens grinding tool 26, which is removably mounted to the shaft 24, is of cup-shaped configuration, including a circular rim portion 44 which is coaxial with a longitudinal axis L of tool and which is radiused about a center of curvature as is apparent from the cross-sectional view thereof in FIG. 3. The rim 44 defines the cutting edge of the tool. Notches 46 are spaced circumferentially around the cutting edge to conduct cooling and flushing water which is sprayed against the cutting edge during a cutting operation.

Formed integrally with the tool and extending rearwardly therefrom is a shank 48 which defines a longitudinal axis that is aligned with the axis of rotation of the shaft 24 when the tool is mounted therein. The shank forms a rearwardly facing flat contact surface 50 disposed perpendicularly to the axis. A cylindrical portion 52 of the shank is of reduced cross-section and projects rearwardly therefrom. The shank includes an internally threaded bore 54 which threadedly receives a draw-bolt 56 passing longitudinally through the shaft in order to draw the shank into the socket 42 of the shaft 24.

Mounted on a cylindrical outer surface of the reduced diameter portion 52 of the shank is a double-tapered collet 58 which can be slidably inserted onto the shank portion 52. The collet 58 includes forwardly and rearwardly facing tapered surfaces 60, 62 (see FIG. 4). The rearwardly facing tapered surface 62 is tapered correspondingly to the forwardly facing tapered socket 42 of the shaft 24. The forwardly facing taper 60 of the collet 58 is shaped correspondingly to a rearwardly facing tapered recess of a collar 64 which is mounted on the collet. A forward end of the collar comprises a contact surface 66 oriented perpendicular to the axis of the shank. That contact surface 66 opposes the contact surface 50 of the shank. Extending around the collet 58 between a rear end of the collar 54 and front end of the shaft 24 is a resilient O-ring seal 68.

The shaft 24, collet 58, and collar 64 together define a mounting assembly for the tool 26. In order to mount the tool, the collet 58, O-ring 68, and collar 64 are mounted on the shank 48. The shank is then inserted into the shaft and is drawn rearwardly by the draw-bolt 56 so that the tapered surfaces 60, 62 of the collet firmly engage the tapered socket of the shaft 42 and the tapered recess 65 of the collar, respectively, to center the tool coaxially with the longitudinal axis. The surfaces 62 of the collet and 42 of the shaft define stop surfaces for positioning the tool. Preferably, the collet includes one or more longitudinal slits which provide a degree of elasticity enabling the collet to be clamped tightly against the shank 48.

As noted earlier herein, when exchanging a tool, a resetting of the tool is necessary since the replacement tool may be of a different longitudinal size than the tool being replaced. That is, the cutting edge 44 of the replacement tool may not lie in the reference plane 70 discussed previously herein in connection with FIG. 2. In that event, the tool cannot be placed with sufficient precision in its various positions of adjustment. Accordingly, prior to the present invention, it would have been necessary to perform a recalibration step by means of the wheel set gauge in the manner described earlier herein, with all the attendant disadvantages.

In accordance with the present invention, however, it is possible to reset the cutting edge simply by displacing the stop surface (e.g., surface 62) carried by the tool, thereby producing a corresponding displacement of the cutting edge. In one preferred embodiment, this can be achieved by inserting shims 80 (FIG. 4) between the contact faces 50, 66 of the shank and collar. The ability to insert shims between those contact surfaces facilitates a resetting of the cutting edge to the required operational position, because the need to unclamp and displace the spindle housing 22 is avoided.

Even greater savings in time and effort are achieved in accordance with a further advantageous feature of the present invention, utilized in conjunction with the abovementioned movable stop surface, which enables the replacement tool to be calibrated off-machine, i.e., the replacement tool can be calibrated while the tool to be replaced is carrying out a cutting function, thereby significantly reducing the down time of the machine. This is accomplished by means of a gauging mechanism 82 depicted in FIGS. 5-8. That gauging mechanism 82 comprises a stand 84 having a base 86, an upstanding post 88, an arm 92 pivotably mounted on the block 90, and a gauge 94 carried at the end of the arm 92. The base forms a seating surface in the form of a flat table 96 disposed beneath the gauge 94.

The gauging mechanism 82 is adapted to gauge a longitudinal dimension defined by the tool. Preferably, this calibration is performed with the tool mounted in a holder 100, and with a collar 64 and double-tapered collet 58 mounted on the tool shank 48. The holder includes a tapered front socket 102 which is identical to that of the shaft 24 in size and configuration. The gauge 94 is a conventional gauge, e.g., a gauge made by Mitutoyo of Japan, which comprises a probe in the form of a vertically movable stem 104 that produces rotation of a pointer 106 about a pivot 107 extending through a dial face 108. The dial face is capable of rotation about the pointer pivot 107 relative to the pointer upon loosening of a set screw 110. The arm 92 is arranged to rotate on a pivot pin 111 about a horizontal axis 112 for reasons to be discussed hereinafter.

Figure 2:
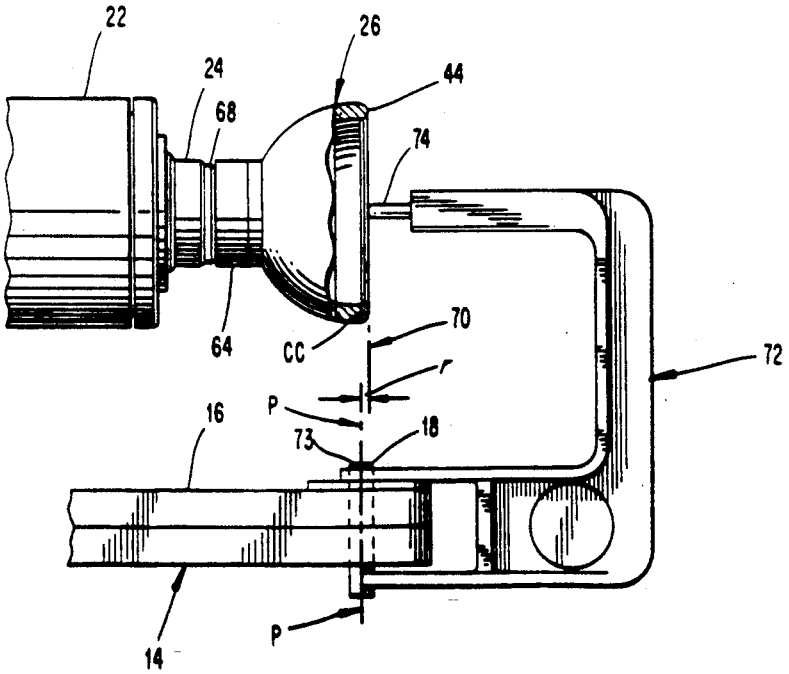
FIG. 2 is a side elevational view of a cutting tool mounted in the machine, and a wheel set gauge mounted on the machine for orienting the cutting edge in a reference plane.

The gauging mechanism 84 is utilized to calibrate all replacement cutting tools, without need for the wheel set gauge 72. Use of the wheel set gauge 72 will be needed only infrequently, such as when the machine 10 is initially received from the manufacturer or when the spindle housing must be removed for cleaning, replacement of bearings, etc. Thus, for example, when the machine is initially received from the manufacturer, an initial calibration will be made to effect a semi-permanent setting of the spindle housing 22 within its clamp. This is preferably achieved by utilizing a tool standard shaped similar to a cutting tool, but manufactured to precision tolerance for use solely in setting the spindle bearing and calibrating the gauge. Thus, the shank of the standard would be provided with a collet 58, O-ring 68 and collar 64, but no shim(s) 80. Such an installation would look as depicted in FIGS. 2 and 3, with the tool-shaped member 26 depicted therein comprising a high-precision standard. Thus, the numeral 26 references either a tool or tool-shaped standard. The tool is drawn rearwardly by the draw bolt 56 until the tapered surfaces 42, 62 on the one hand and 60, 65 on the other hand are tightly engaged. Thus, the O-ring 68, which is provided solely as a seal against the cooling and flushing water, does not limit the extent to which the parts can be brought together. The wheel set gauge 72 is then installed on the pivot pin 73 (FIG. 2) and the spindle housing 22 is advanced until the rim 44 of the standard contacts the gauge pin 74. The spindle housing is then tightly clamped down.

The standard is then employed to calibrate the gauging mechanism 84. This is performed by removing the standard from the shaft, together with the collar 64, collet 58 and O-ring 68 (but no shims) and installing same tightly into the holder 100 (FIG. 6) by means of a threaded bolt 114 which draws the standard toward the holder socket 102 in the same way that the draw bolt 56 draws the standard toward the shaft 24.

The holder 100 and standard are then placed upon the table 96 of the gauging mechanism as depicted in FIGS. 6 and 7. The gauge stem 104 is raised and permitted to rest against the rim 44, causing the pointer 106 to assume a rest position relative to the dial face 108. The dial face is adjusted by loosening the set screw 110 and rotating the dial face about the pivot axis 107 until the pointer indicates a zero reading on the dial face. The arm 92 is rotated around its pivot axis 112 so that the gauge stem 104 rotates within a plane of rotation while resting upon the rim of the standard to assure that the gauge reads zero at all locations around the curvature of the rim (see FIGS. 8, 9). In that regard, the pivot axis 112 is arranged to (a) intersect a projection of the gauge stem 104, and (b) lie in a horizontal plane containing the center of curvature CC of the rim of the standard.

Provision is made for releasably retaining the arm 92 in various positions in its path of rotation to facilitate setting the gauge. This is preferably achieved by fixedly attaching a knob 120 at the end of the arm pivot pin 111 so that the knob is rotatable with the pivot pin. An inner surface 122 of the knob faces a surface 123 of the block 90. The knob surface is provided with a series of circumferentially spaced indentations 124 which are engageable by a spring-biased detent, such as a ball 126, mounted in the block surface. The gauge 94 can thus be retained in a plurality of positions (e.g., five positions A–E) in its path of travel about the pivot axis 112, in order to permit the gauge to be read and adjusted at each position.

The table carries a guide bar 113 against which the holder 100 may abut. Movement of the holder along that guide bar, i.e., movement of the holder in the plane of the paper in FIG. 6, assures that the gauge stem 104 will contact the rim at a location wherein the center axis of curvature CC of the rim 44 is substantially aligned with the axis 112. That means that the longitudinal axis L of the circular cutting edge must lie within the plane of rotation of the stem 104; otherwise the center of curvature CC would not be aligned with the axis 112 (compare FIG. 7 and 9). In this manner, it is assured that accurate readings will be obtained as the arm 92 is rotated and the stem 104 travels around the rim curvature.

With such gauging of the tool accomplished, it is assured that any tool which is placed in the holder and which causes the gauge to zero-out will, when subsequently installed in the machine shaft, have its cutting edge disposed in the vertical reference plane 70. Thus, while one tool is being utilized in a cutting operation, a replacement tool can be gauged off-machine by being fitted with a collar, O-ring, and collet, inserted into a holder and calibrated in the calibrating mechanism. If the pointer does not indicate a zero reading, one or more shims 80 are inserted between the contact surfaces 50, 66 until such a zero reading is attained. When the replacement tool is removed from the holder and installed in the shaft socket 42, the cutting edge will lie in the reference plane 70. That procedure, then, eliminates the need to remove the splash hood, attach a wheel set gauge 72 to the machine, and unclamp and displace the spindle housing 22, as well as the need to uncouple water hoses and scrape embedded glass dust from the spindle bearing. The only down time to which the machine is subjected, therefore, is the down time required to remove the in-place tool and install the replacement tool. Such an exchange can be done in less than five minutes, in contrast to a one to two hour down time which typically accompanies the conventional tool exchange/recalibration procedure utilizing the on-machine gauge 72.

Within the purview of the present invention, means other than shims could be employed to displace the stop surface carried by the tool (e.g., the stop surface 62 defined by the collet). For example, the collar 64A could be longitudinally adjustably positionable on the shank, as by having internal threads threadedly connected to an external thread on the shank as depicted in FIG. 12. Thus, in the event that it is necessary to raise the elevation of the cutting edge in order to zero-out the gauge, the collar would be rotated relative to the shank and thereby be displaced rearwardly in a manner causing the elevation of the cutting edge to be raised in the same manner as would be achieved by the use of shims. This would produce a corresponding rearward displacement of the stop surface defined by the collet 58A. The collar could then be locked to the tool shank by a set screw (not shown) or the like once the gauge has been zeroed-out.

If desired, the collar could carry a rearwardly projecting tapered stop surface which directly engages the tapered socket of the shaft, thereby eliminating the need for the collet.

As a further alternative in the case where shims are utilized, shims could be employed wherein the rearwardmost shim defines the adjustable stop surface which contacts a stop surface carried by the tool mounting assembly, e.g., a front edge of the shaft 24. In such a case, the replacement tool would be gauged in the gauging mechanism while mounted in a holder which simulates the tool mounting assembly, i.e., in the absence of a double-tapered collet and collar, and shimmed-up as necessary to zero-out the gauge. Then, the tool and shim(s) would be removed from the holder, and the tool would be inserted into the shaft such that the shims are sandwiched directly between the tool and a front edge of the shaft.

In lieu of employing a tool standard for initially calibrating the gauge 94, it is possible to employ a cutting tool. However, the use of a standard is preferred since the latter is manufactured with precision dimensional tolerances. Furthermore, the cutting tools are manufactured with a dimensional tolerance based upon that of the standard. That is, the tools have a minus tolerance only, i.e., no plus tolerance, to assure that the tools may be shorter, but not longer, than the standard. Accordingly, there will only occur situations in which recalibration of the tool requires the addition of shims (rather than situations in which the tool is too long whereby an adjustment of the spindle housing 22 would be required).

Figure 4:
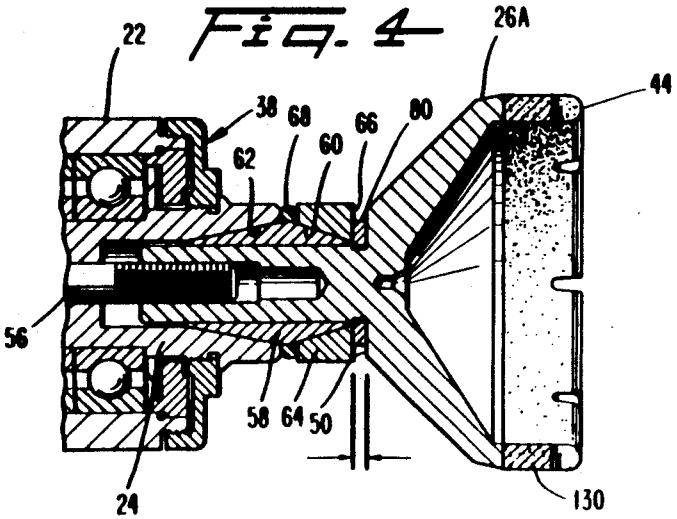
FIG. 4 is a longitudinal sectional view through a front portion of the spindle bearing, depicting a different type of cutting tool.

In the tools 26, 26A depicted in FIGS. 3 and 4, respectively, the arcuate, preferably circular, cutting edge 44 is defined by a layer of abrasive grinding material 130 bonded to the tool in any suitable fashion. The layer 130 extends longitudinally rearwardly farther than the notches 46 to provide an additional depth of cutting edge which may be used even after the cutting edge has been worn to the full depth of the notches.

In performing calibration operations in accordance with the present invention, a spindle housing 22 may be initially set by means of the conventional wheel gauge 72, whereby a tool standard 26 has its front rim 44 oriented in a reference plane 70 of the machine. The spindle housing 22 is then clamped tightly in position. The tool standard 26 is then mounted in a holder 100 and the standard and tool are inserted onto the gauging mechanism 84, whereupon the gauge 94 is zeroed-out.

It is now assured that any cutting tool mounted in the holder which causes the gauge to zero-out when mounted in the gauging mechanism, will have its cutting edge 44 properly located so as to lie within the reference plane 70 upon being installed in the lens grinding machine. In the event that such a tool does not zero-out the gauge, shims 80 may be inserted between the contact surfaces 50 and 66 defined by the cutting tool and collar 64, respectively, until the gauge is zeroed-out. Alternativey, the collar 64A (FIG. 12) could be rotated until the gauge is zeroed-out. Importantly, this operation may be carried out off-machine so that the machine may continue to perform a cutting operation. Therefore, the only down time to which the machine is subjected is the time required for removing one tool and inserting the replacement tool. That operation does not require an unclamping of the spindle bearing, or a removal of the splash hood, or a scrapping of embedded glass dust from around the spindle bearing. It has been found that the down time to which a machine is subjected in accordance with the present invention may be less than five minutes, as compared to a down time of one to two hours in connection with prior art toolreplacement operations.

It is advantageous that the gauge 94 may be rotated about the axis 112 in order to zero-out the gauge at numerous positions around the curvature of the cutting edge, thereby assuring a highly precise orientation of the cutting edge when mounted in the machine, as well as being able to detect abnormal wear on portions of the cutting edge.

The provision of a cutting tool with a planar surface 50 oriented perpendicular to the axis of the tool, accommodates the use of shims 80 in carrying out the present invention.

Although the present invention has been described in connection with preferred embodiments thereof, it will be appreciated by those skilled in the art that additions, modifications, substitutions, and deletions not specifically described may be made without departing from the spirit and scope of the invention as defined in the appended claims.

What is claimed is:

1. A gauging mechanism for gauging a longitudinal dimension defined by a lens grinding tool of the type having an arcuate rim defining a circular cutting edge which is coaxial with respect to a longitudinal axis of said tool, said rim being arcuate such that said cutting edge is radiused about a center axis of curvature, said gauging mechanism comprising a stand forming a table defining a tool seating surface on which the tool is seated to orient said longitudinal axis thereof vertically, an arm disposed above said tool seating surface, and a gauge mounted on said arm so as to be positioned over said tool seating surface, said gauge including a depending probe extending downwardly toward said tool seating surface, said probe being adapted to engage the cutting edge of the lens cutting tool seated on said tool seating surface, and an indicator driven by said probe, said arm being rotatable about an axis extending substantially perpendicular to a projection of said probe so that said probe is rotatable about said axis within a vertical plane disposed perpendicular to said first axis to enable said probe to engage the cutting edge at a plurality of locations around the curvature thereof, said stand including guide means for locating said tool such that a longitudinal axis of said tool lies within said vertical plane.

2. A gauging mechanism according to claim 1, wherein said table includes a guide bar defining said guide means.

3. A gauging mechanism according to claim 1, including means releasably retaining said arm in various positions of movement about said axis.

* * * * *